US007033268B2

(12) United States Patent
Caliendo et al.

(10) Patent No.: US 7,033,268 B2
(45) Date of Patent: Apr. 25, 2006

(54) MULTI-MODE DAMPER ACTUATOR

(75) Inventors: Guy Caliendo, Algonquin, IL (US); Martin Buck, Chicago, IL (US)

(73) Assignee: Siemens Building Technologies, Inc., Buffalo Grove, IL (US)

( * ) Notice: Subject to any disclaimer, the term of this patent is extended or adjusted under 35 U.S.C. 154(b) by 0 days.

(21) Appl. No.: 10/418,186

(22) Filed: Apr. 17, 2003

(65) Prior Publication Data

US 2004/0209566 A1 Oct. 21, 2004

(51) Int. Cl.
*A62C 2/12* (2006.01)

(52) U.S. Cl. ..... 454/369; 236/44

(58) Field of Classification Search ..... 454/369, 454/342, 357; 169/42; 236/49
See application file for complete search history.

(56) References Cited

U.S. PATENT DOCUMENTS 4,422,571 A * 12/1983 Bowman ..... 236/49.3
4,432,272 A * 2/1984 Vans Becelaere ..... 454/369
4,463,896 A * 8/1984 Schaus ..... 236/49.2
4,605,983 A * 8/1986 Harvey ..... 361/154
4,738,189 A 4/1988 White et al.
4,818,970 A 4/1989 Natale et al.
4,821,955 A * 4/1989 Kline et al. ..... 236/49.5
5,310,021 A 5/1994 Hightower
5,788,571 A 8/1998 Ivison et al.
5,810,662 A 9/1998 Van Becelaere
5,976,010 A * 11/1999 Reese et al. ..... 454/229
6,249,100 B1 * 6/2001 Lange ..... 318/471
6,286,537 B1 * 9/2001 Backham et al. ..... 137/79
6,447,393 B1 9/2002 McCabe

* cited by examiner

*Primary Examiner*—Derek S. Boles

(57) ABSTRACT

A damper actuator for a ventilation damper serves as both a control device for the ventilation damper and a fire and smoke rated device for the ventilation damper. The damper actuator includes a modulating motor controller, a two-point motor controller, and a thermal switch or switch like device that is operative to switch control of the motor from the modulating motor controller used during normal operation, to the two-point motor controller during a fire and smoke condition. The damper actuator provides an automatic and permanent disabling (by-passing) of the modulating motor controller functions the first time a pre-determined temperature level (switch point) is reached via the thermal switch or switch like device. Once the modulating motor controller is disabled, the actuator no longer supports the advanced motor control functions (i.e. the modulating control). Thereafter, the thermal switch or switch like device enables a two-point motor controller that is operative to put the damper into either a fully open or a fully closed position.

18 Claims, 5 Drawing Sheets

MULTI-MODE DAMPER ACTUATOR

FIELD OF THE INVENTION

The present invention relates generally to building control systems, and more particularly, to ventilation and life safety dampers for use in building control systems.

BACKGROUND OF THE INVENTION

Building control systems control various aspects of a building, including comfort, safety, lighting and other aspects. With respect to comfort, one aspect of a building control system includes heating, ventilation and air conditioning (HVAC). An HVAC system involves conditioning of the air within an area, zone or room. Such conditioning includes providing heated air, cooled air, fresh air, circulated air and/or the like to the particular area depending on various factors. The HVAC system includes a system of ducts that terminate in particular areas or zones. The termination points are controlled by ventilation dampers or damper systems. Each ventilation damper/damper system is operative to control the flow of air from the respective termination point.

Ventilation dampers/damper systems are thus one component of a building control system that are used to help with the aspect of comfort and safety. In summation, ventilation dampers/dampers systems (collectively, dampers) are used for temperature control, pressure regulation, air circulation and/or replacement of stale air.

Basic dampers are positionable into either a fully opened or a fully closed position. This provides only either full air flow or no air flow. It is better, however, to use intermediate levels of openness in addition to the fully opened and fully closed positions in order to better control ventilation. For example, in order to maintain a particular temperature, the damper may be opened to allow the flow of conditioned air into the room. If only two states (open and closed) are allowed, the system will constantly be cycling on and off to maintain the particular temperature. With intermediate levels of openness, an amount of conditioned air may be gradually modulated into the room/zone until a quasi-steady state level is achieved (in other words, the flow of conditioned air through the damper more or less equals the thermal load variables within the room that are changing the controlled air requirements of the room).

Modulating control dampers achieve this elevated level of control over damper position and thus provide better control over temperature, pressure regulation and/or air replacement. Modulating control dampers include a modulating control. The modulating control typically receives signals representative of a particular position (percentage open) and then control an actuator to achieve that position in accordance with particular parameters. A modulating control actuator is used to control position of the damper and thus control air flow. The modulating control utilizes digital and/or analog circuits that operate a motor to cause the damper to travel to and stop in the position identified by the received controls.

It has been recognized that the needs of the ventilation system change in the presence of fire and its attendant smoke. In certain situations, it is advantageous to vent heat away from affected areas unless smoke is present, in which case the area should be sealed. Ventilation dampers may be configured to perform such functions during a fire and smoke event.

Dampers having modulating control typically cannot be used for fire and smoke events because the circuits that control position of the motor are not resilient enough to tolerate the extensive heat that accompanies such fire and smoke events. Indeed, standards define the conditions under which the above described fire and smoke operation must be able to be carried out. The types of digital and analog circuitry that currently perform modulating control may not meet those standards.

Accordingly, the prior art has employed separate dampers in the ducts of buildings, i.e. one damper for comfort control and one damper for fire and smoke control. The comfort control damper may employ a modulating actuator control that opens the damper to a select position of large number of positions. The fire and smoke control damper employs a simpler two-state actuator control that is either open or closed. With this system, the comfort control damper and actuator need not operate fully or function in any manner during a fire and smoke event, and may thus employ significant position control circuitry. Meanwhile, the fire control damper requires fewer control elements, and thus can readily be made to withstand the higher temperature operating requirements.

One problem with the above-described arrangement for providing dampers in a building control system is the cost associated with requiring multiple dampers for multiple functions for the same room or space. There is a need, therefore, for a system that overcomes the shortcomings of the prior art ventilation damper arrangements.

SUMMARY OF THE INVENTION

The subject invention addresses the above need, as well as others, by providing a damper system that incorporates both modulating control and fire and smoke control. Particularly, the subject invention provides a dual mode actuator for a damper that disengages modulating control circuitry when a detected temperature exceeds a threshold, and engages a simpler temperature resilient control circuitry for the actuator that moves the damper. Thereafter, the subject invention provides automatic closure of the damper upon power interruption.

The subject invention provides a ventilation damper actuator that serves as both a control device for the ventilation damper and a fire and smoke rated device for the combination ventilation/fire and smoke rated damper. The subject invention provides an automatic and permanent disabling (by-passing) of advanced modulating motor control functions the first time a pre-determined temperature level (switch point) is reached. This is accomplished with a thermal switch, fuse, sensor, and/or the like. Once the advanced circuitry is disabled, the actuator no longer supports the advanced motor control functions (i.e. the modulating control). Thereafter, the thermal switch enables a two-point motor controller that is operative to put the damper into either a fully open or a fully closed position.

By using this scheme, the electronics of the drive circuitry are simplified. Additionally, motor operation is ensured at elevated temperatures that may not be realized with the advanced circuitry (i.e. modulating circuitry) since the advanced circuitry may be difficult and costly to realize at high temperatures.

In yet another form, there is provided a damper actuator having a motor adapted to be coupled to a damper, a thermally actuated switch coupled to the motor, modulating motor control circuitry coupled to the switch; and two-point motor control circuitry coupled to the switch. The thermally actuated switch has a first state wherein the modulating motor control circuitry is coupled to the motor for operational control of the motor and the two-point motor control circuitry is decoupled from operational control of the motor, and a second state wherein the two-point motor control circuitry is coupled to the motor for operational control thereof and the modulating motor control circuitry is decoupled from operational control of the motor.

The above-described features and advantages, as well as others, will become more readily apparent by reference to the following detailed description and accompanying drawings.

DETAILED DESCRIPTION

The above-described embodiments are merely exemplary, and those of ordinary skill in the art may readily devise their own implementations and modifications that incorporate the principles of the present invention and fall within the spirit and scope thereof.

Figure 1:
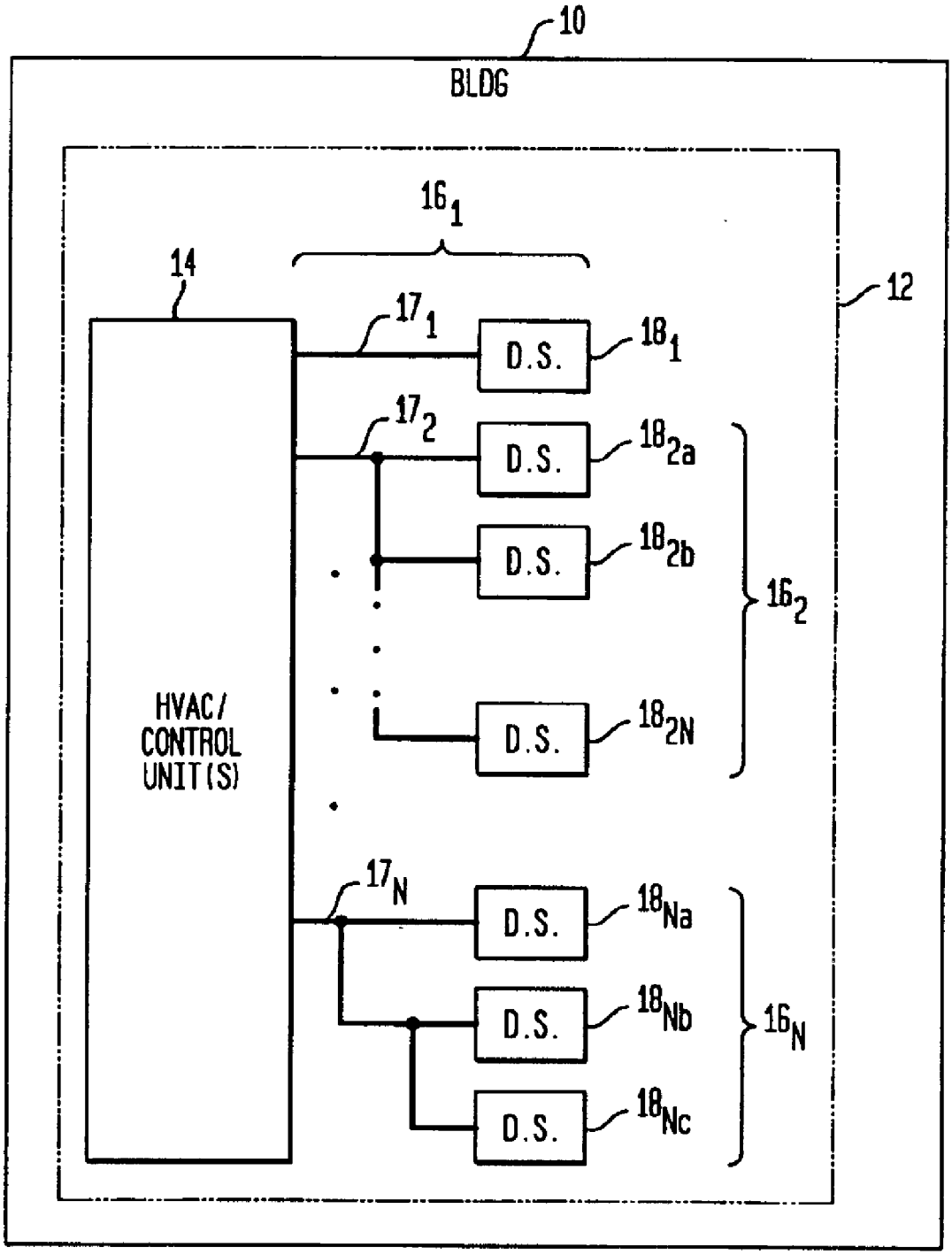
FIG. 1 shows a block diagram representation of a building having an HVAC/control system including ventilation damper systems in accordance with the present principles.

With reference now to FIG. 1, there is depicted a representation of a building generally designated 10 in which the subject invention may, and typically is, used. It should be appreciated that the building 10 is representative of any structure that has a ventilation system or systems such as a house, multi-story building or the like. The building 10 has a ventilation/ventilation control system such as an HVAC/control system 12 having various HVAC and control components some of which are hereinafter discussed, including the subject invention, and some of which are known in the art. The HVAC/control system 12 includes HVAC and control unit(s) 14 representative of heating, air conditioning, and/or other ventilation sources/components/systems, equipment and/or the like such as are well known in the art, and control sources/components/systems.

As is typical, the HVAC/control system 12 includes a plurality of air flow/control systems generally designated $\mathbf{16}_1$, $\mathbf{16}_2$ through $\mathbf{16}_N$ that direct the flow of air from the HVAC units to various places in the building 10 and which thereafter control the flow of air into the various places. Such places may be rooms, zones, areas or the like. Each air flow/control system $\mathbf{16}_1$, $\mathbf{16}_2$ through $\mathbf{16}_N$ is characterized by a series of ducts or ductwork and communication/control lines both of which are concurrently represented by lines $\mathbf{17}_1$, $\mathbf{17}_2$ through $\mathbf{17}_N$. Each line $\mathbf{17}_1$, $\mathbf{17}_2$ through $\mathbf{17}_N$ terminates in at least one damper system (D.S.). Each damper system (D.S.) provides adjustable control of air flow from the lines $\mathbf{17}_1$, $\mathbf{17}_2$ through $\mathbf{17}_N$ into the particular areas or zones of the building 10, particularly under control of the control system(s). In accordance with the principles of the subject invention, each damper system D.S. also provides fire and smoke protection. The fire and smoke protection is in accordance with industry standards.

The ducts or ductwork provide passageways for directing air flow from the HVAC units(s) 14 to various places (e.g. rooms, zones or the like) of the building 10. Shown in FIG. 1 for illustrative purposes, are various exemplary manners in which the ducts may be configured and/or terminated. Particularly, the system $\mathbf{16}_1$ has a single duct $\mathbf{17}_1$ that terminates in a single damper system $\mathbf{18}_1$. The system $\mathbf{16}_2$ has a duct system $\mathbf{17}_2$ that has various branches from a main duct thereof, each of which terminates in a damper system $\mathbf{18}_{2a}$, $\mathbf{18}_{2b}$ through $\mathbf{18}_{2N}$. The system $\mathbf{16}_N$ has a variable branch duct system that terminates in damper systems $\mathbf{18}_{Na}$, $\mathbf{18}_{Nb}$ and $\mathbf{18}_{Nc}$.

Figure 2:
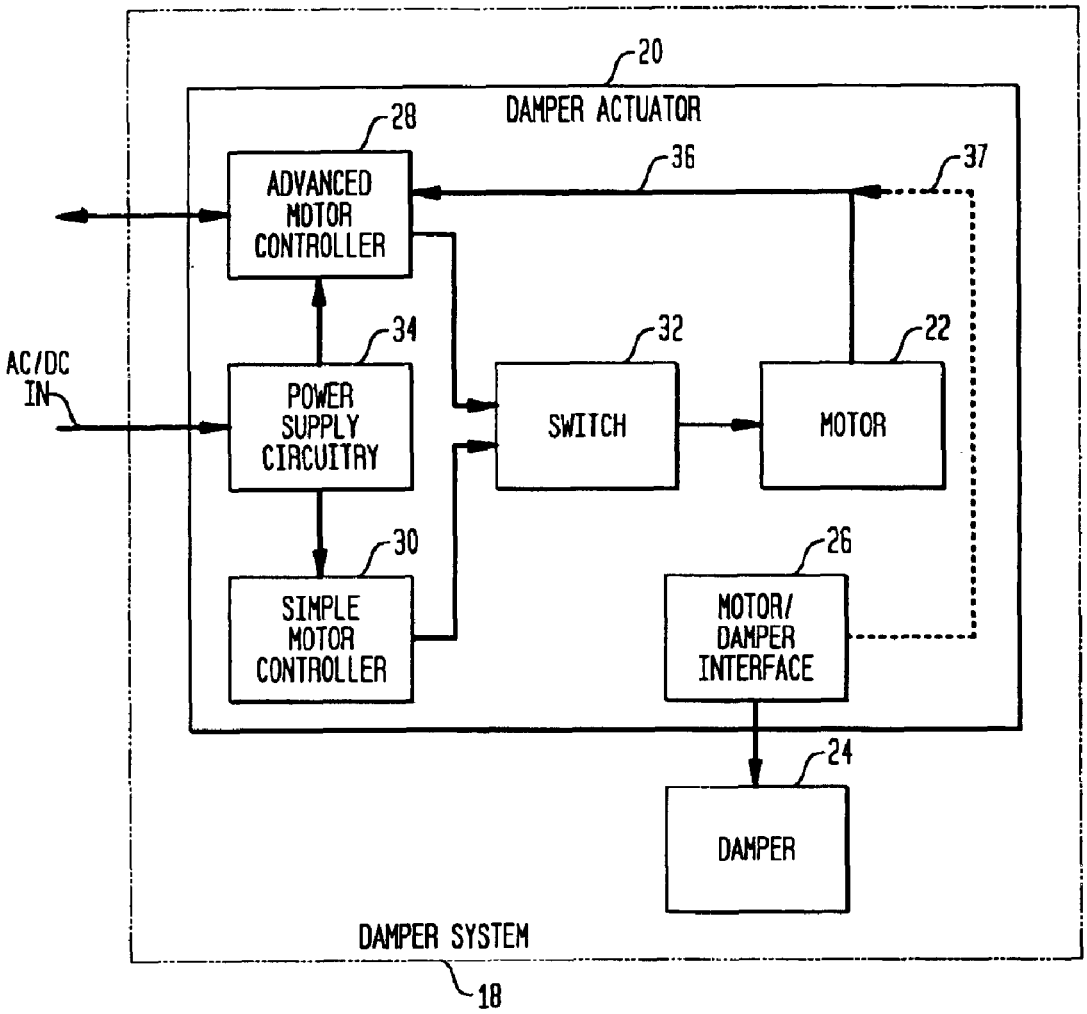
FIG. 2 shows a block diagram of a ventilation damper system in accordance with the principles of the subject invention.

Referring now to FIG. 2, there is depicted a block diagram of an exemplary damper system 18. The damper system 18 includes an actuator, actuating circuitry, motor, damper interface, control logic or the like 20 (collectively, "actuator"). In a preferred embodiment, the motor 22 is a brushless DC (BLDC) motor. Other types of motors both AC and DC, however, may be used such as a synchronous motor, a brush DC motor, a shaded pole motor and/or the like. The actuator 20 is operative, configured and/or adapted to control the damper 24. Particularly, the actuator 20 controls the opening, closing and/or various intermediate positions of the damper 24. This is accomplished through a motor/damper interface 26. The damper interface 26 translates the rotational motion of the motor 22 into motion that moves the damper 24 and may or may not including gearing.

The actuator 20 includes an advanced motor controller, control circuitry, logic or the like 28 and a simple motor controller, control circuitry, logic or the like 30. In a preferred form, the advanced motor controller 28 is what is known as a modulating controller while the simple motor controller 30 is what is known as a two-point controller. While explained more fully below, the advanced motor controller 28 is operative, configured and/or adapted to provide control signals to the motor 22 that allow the motor 22 to provide precise control of the damper 24 through the motor/damper interface. Particularly, the advanced motor controller 28 provides control signals to the motor 22 that, through the motor/damper interface 26, controls the damper 24 such that the damper 24 provides a fully open condition wherein the flow of air through the damper 24 is unrestricted, a fully closed condition wherein the flow of air through the damper 24 is totally restricted, and a plurality of variable positions between the fully open and fully closed positions wherein the flow of air through the damper is restricted to a degree between the fully open and fully closed positions.

In one form, position of the motor/damper interface 26 may be accomplished with the aid of motor position feedback represented by the arrow 36 emanating from the motor 22 to the advanced motor controller 28. The actuator 20 may have encoding or the like that provides the necessary feedback to determine rotational position of the damper interface 26. This rotational position may then be used by the advanced motor controller 28 to determine damper position. For example, rotation of the motor a certain number of revolutions in one direction may be known to move the damper into 50% of being open relative to a fully open or fully closed position (i.e. halfway between a fully open position and a fully closed position). As another example, each number of revolutions of the motor 22 may be known to move the damper 24 a known amount. This ratio may be dependant on possible gearing internal to the actuator 20.

In another form, position of the damper may be accomplished in a time based manner. For example, applying a control signal of a given length from the advanced motor controller 28 may be known to move the damper 24 a given amount. The time that the control signal is applied thus translates into movement of the damper. This may be accomplished in both rotational directions.

It should be appreciated, that such feedback may be provided from the motor/damper interface 26 as represented by the dashed arrow 37 emanating from the motor/damper interface 26 rather than the motor 22 or in conjunction therewith. In one form, the motor/damper interface 26 may utilize a potentiometer that changes resistance in proportion to rotational movement thereof. This resistance change is provided to one input of a comparator in the advanced motor controller 28, while another input of the comparator receives a desired position signal. Output of the comparator determines whether the motor is turned on until the desired position is achieved, or is not turned on.

Another manner of tracking position with respect to time may be accomplished by using a constant speed reverse rotation braking circuit such as is known in the art. In this configuration, the motor 22 is turned at a constant speed in one rotational direction and tracked according to time. A spring return operatively coupled to the motor 22 rotates the motor 22 in the reverse rotational direction according to a controlled and known speed. In this manner, the time it takes to reverse direction may be tracked to know the position of the damper 24.

The advanced motor controller 28 is preferably in two-way communication with control units, sensors and/or the like (not shown) of the overall HVAC system as represented by the double-headed arrow in FIG. 2. Such control units, sensors and/or the like may include such components as thermostats and air flow monitors. The advanced motor controller 28 utilizes control signals from the control units, sensors and/or the like to control damper in any modulated position. The advanced motor controller 28 may also provide feedback as necessary.

Again, while explained more fully below, the simple motor controller 30 is operative, configured and/or adapted to provide control signals to the motor 22 that allow the motor 22 to position the damper 24 into either the fully open position or the fully closed position. Particularly, the simple motor controller 30 provides control signals to the motor 22 that, through the motor/damper interface 26, controls the position of the damper 24 such that the damper is either in the fully open or the fully closed position.

The damper actuator 20 preferably, but not necessarily has a power supply, power supply circuitry, logic or the like 34. The power supply 34 is operative, configured and/or adapted to receive either AC or DC power (AC/DC IN) and provide appropriately conditioned AC or DC power to the advanced motor controller and the simple motor controller.

The advanced motor controller 28 and the simple motor controller 30 are each connected to a switch or switch like device 32 that is, in turn, connected to the motor 22. The switch 32 is operative, configured and/or adapted to provide either the control signals from the advanced motor controller to the motor 22 or control signals from the simple motor controller 30 to the motor 22. In a normal mode, the switch 32 connects the advanced motor controller 28 to the motor 22 for operational control thereof and by-passes connection of the simple motor controller 30. In a fire and smoke mode, the switch or switch like device 32 disconnects (by-passes) the advanced motor controller 28 from operational control of the motor 22 and couples or connects the simple motor controller 30 to the motor 22 for operational control of the motor 22. The switch or switch like device 32 thus provides a first or normal state of operation and a second or fire state of operation.

The switch or switch like device 32 is caused to change states based on a thermal condition. Particularly, the switch or switch like device 32 is a thermal switch that is operative, configured and/or adapted to be actuated when a predetermined temperature is reached. The switch or switch like device 32 itself may incorporate a thermal sensor that operates to cause the switch to change states, or may utilize an outside thermal control signal that may be generated by a thermal sensor and provided to the switch or switch like device 32. In a preferred form, the switch 32 is a one-way thermostatic switch such as that made by Selco Products of Anaheim, Calif. Once the one-way thermostatic switch changes states, it will not change back. In this manner, the damper actuator 20 is a one-time use fire and smoke emergency type device (i.e. once it is triggered due to thermal conitions, a new damper actuator must be installed). It should be appreciated, however, that other switching devices may be used that provide a change in states based on a thermal condition (i.e. a pre-determined temperature being reached).

Figure 3:
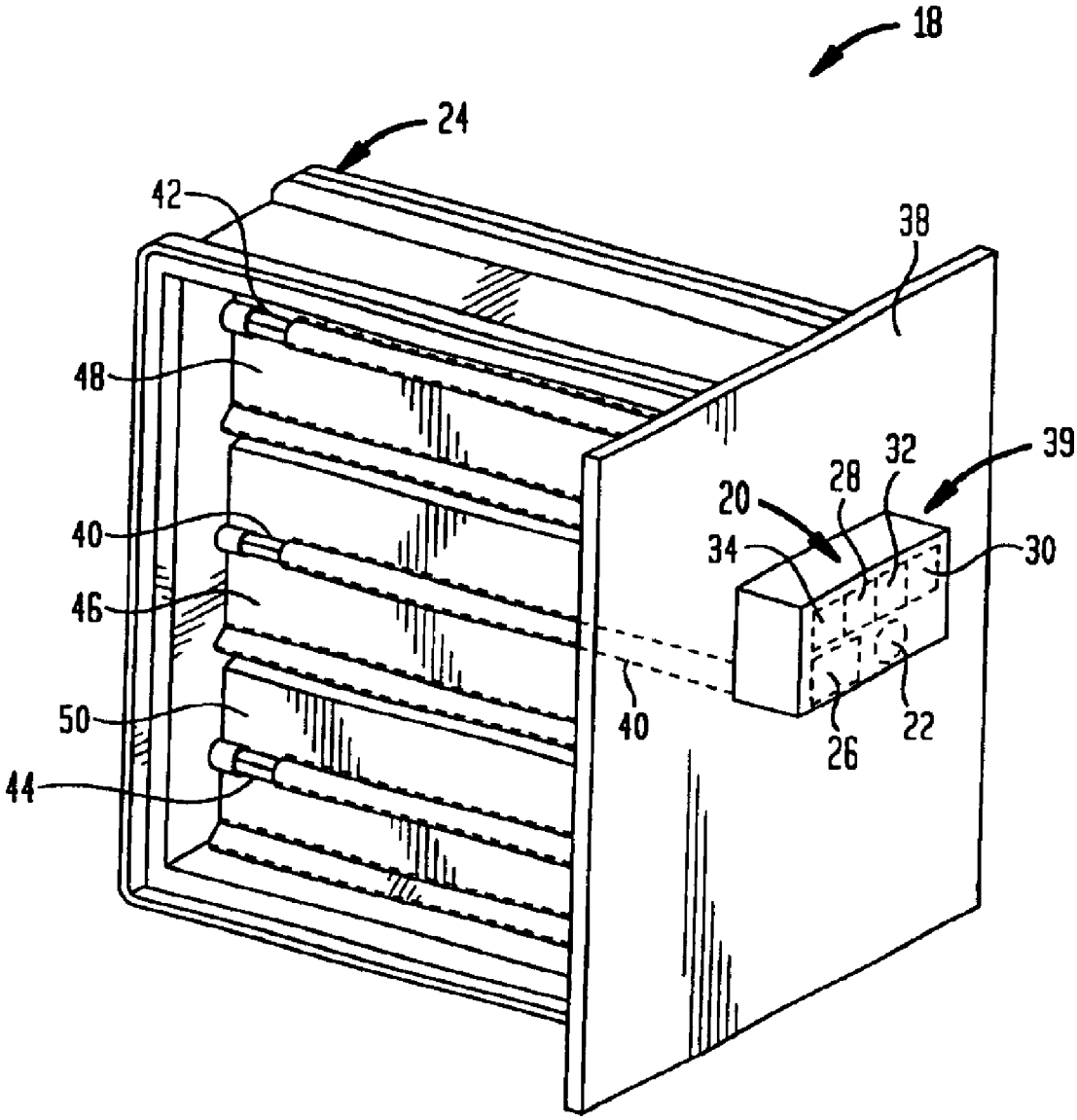
FIG. 3 shows a perspective view of an exemplary damper system.

Referring now to FIG. 3, there is depicted an exemplary damper system 18 having an exemplary damper 24 to which is attached a damper actuator module 39. The damper actuator 20 houses the motor 22, the motor/damper interface 26, control electronics, etc. It should be appreciated that the damper 24 is only exemplary of a style or type of damper and that other styles, configurations and/or types of dampers may be utilized. The damper 24 of FIG. 3, however, provides an illustration of the manner in which most dampers control the flow of air therethrough.

The damper 24 includes a frame 38 that carries a control shaft 40. The control shaft 40 is coupled to the motor/damper interface 26 such that the motor/damper interface 26 is operative to move the control shaft 40 appropriately. Particularly, the control shaft 40 is coupled to the motor/damper interface 26 such that the motor/damper interface 26 is operative to controllably rotate the control shaft 40 about its longitudinal axis. The control shaft 40 is coupled to an upper shaft 42 and a lower shaft 44 such that rotation of the control shaft 40 also rotates the upper shaft 42 and the lower shaft 44 or any multiple of auxiliary blades.

The control shaft 40 is coupled to a vane, blade or the like 46 such that rotational movement of the control shaft 40 rotates the vane 46 about the control shaft 40. The upper shaft 42 is coupled to a vane, blade or the like 48 such that rotational movement of the upper shaft 42 rotates the vane 48 about the upper shaft 42. The lower shaft 44 is also coupled to a vane, blade or the like 50 such that rotational movement of the lower shaft 44 rotates the vane 50 about the lower shaft 44. Thus, rotation of the control shaft 42 rotates the vane 46 as well as the upper and lower shafts 42, 44 which, in turn, rotate the vanes 48 and 50. As the vanes 46, 48 and 50 rotate, they open up the damper 24 to the flow of air therethrough. The damper 24 is thus able to be controlled to provide a fully open position, a fully closed position, and positions intermediate the fully open and fully closed positions through controlled rotation of the control shaft 40. Of course, it should be appreciated that rotation of the control shaft 40 is ceased when a particular (desired) air flow position is achieved.

It should be appreciated that the damper 24 in FIG. 3 is depicted in the fully closed position. In this position, the vanes 46, 48 and 50 are perpendicular to the flow of air through the damper 24 and thus prevents same. A fully open position has the vanes 46, 48 and 50 parallel to the flow of air through the damper 24. The intermediate positions have the vanes 46, 48 and 50 at a rotational angle between perpendicular and parallel.

As indicated above, the control shaft 40 is coupled to the motor/damper interface 26. The motor 22, under control by either the advanced motor controller 28 or the simple motor controller 30, depending on whether there is a normal mode or a fire/smoke mode, actuates the motor/damper interface 26 which, in turn, rotates the control shaft 40.

Figure 4:
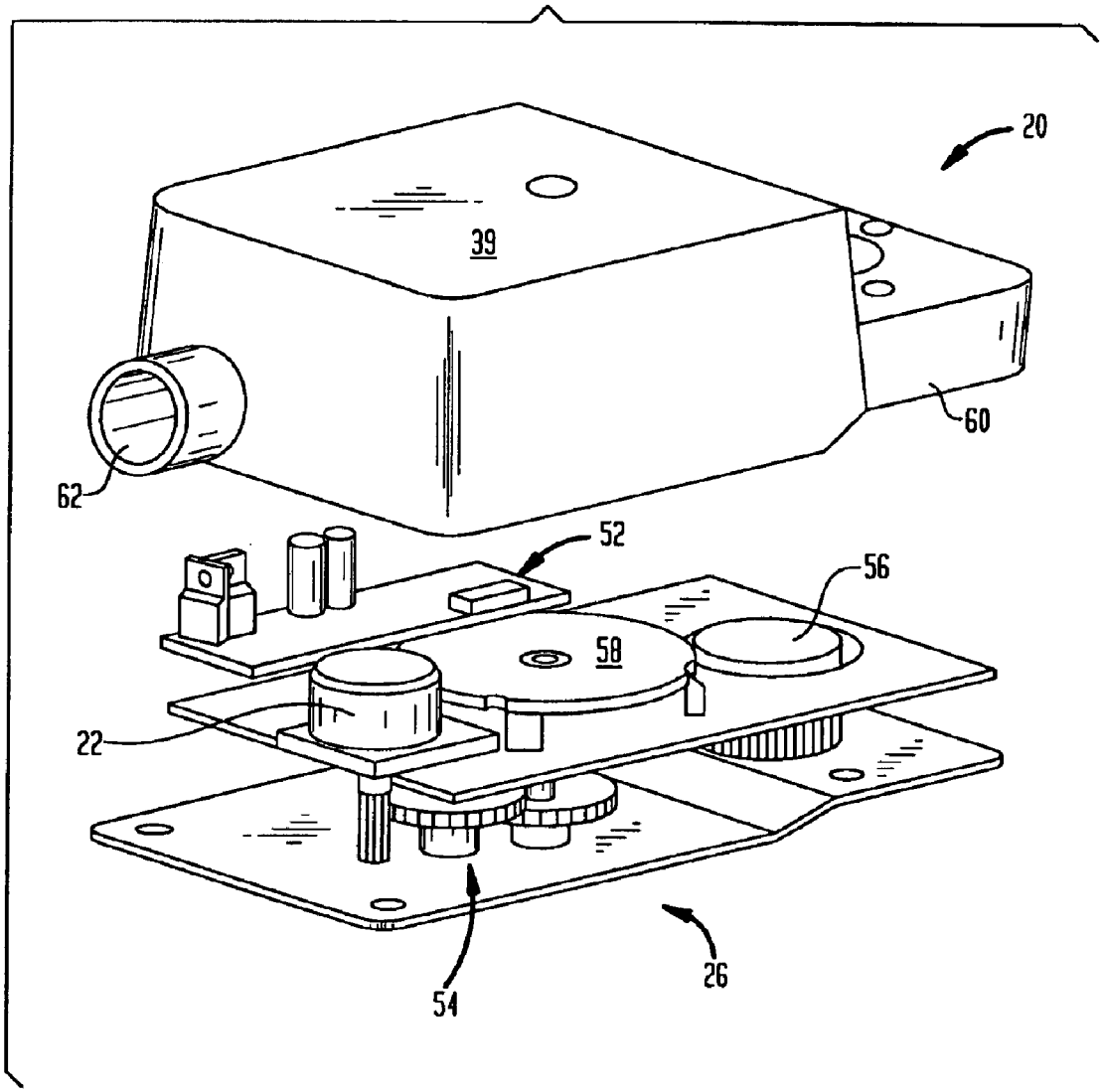
FIG. 4 shows an exploded perspective view of the actuator in accordance with the principles of the subject invention.

Referring to FIG. 4, there is depicted an exploded view of an example actuator 20. The actuator 20 includes a housing 60 that encloses the motor 22, a printed circuit assembly 52 that contains the modulating motor control/controller circuitry 28 and the two-point motor control/controller circuitry 30 (both of which are not specifically delineated thereon), a gear train 54 that is operatively connected to the motor 22, and a control shaft coupling 56 that is operatively connected to the gear train 54. The control shaft coupling 56 is operative, configured and/or adapted to receive the control shaft 40 and rotate same. Moreover, the actuator 20 may include a mechanical spring return 58 that is operative to control the control shaft coupling 56 when power to the actuator 20 ceases. Other means of returning the actuator 20 to it's zero position may also be employed.

Particularly, when the power to the actuator 20 is cut off because of a smoke controller or sensor (not shown) detects smoke because of a fire condition or any other emergency situation, and thus the modulating controller 28 and the two-point controller 30 are inoperative due to power loss, the mechanical spring return 58, or any other fail to zero position mechanism, causes the control shaft coupling 56 to position the control shaft 40, and thus the vanes of the damper 24, to close thereby putting the damper 24 into a fully closed or fully open position. During the time that either the modulating controller 28 and the two-point controller 30 are operative, the spring tension on the mechanical spring return 58 ,or any other fail to zero position mechanism, is overcome or overridden by the motor 22 or other means.

Figure 5:
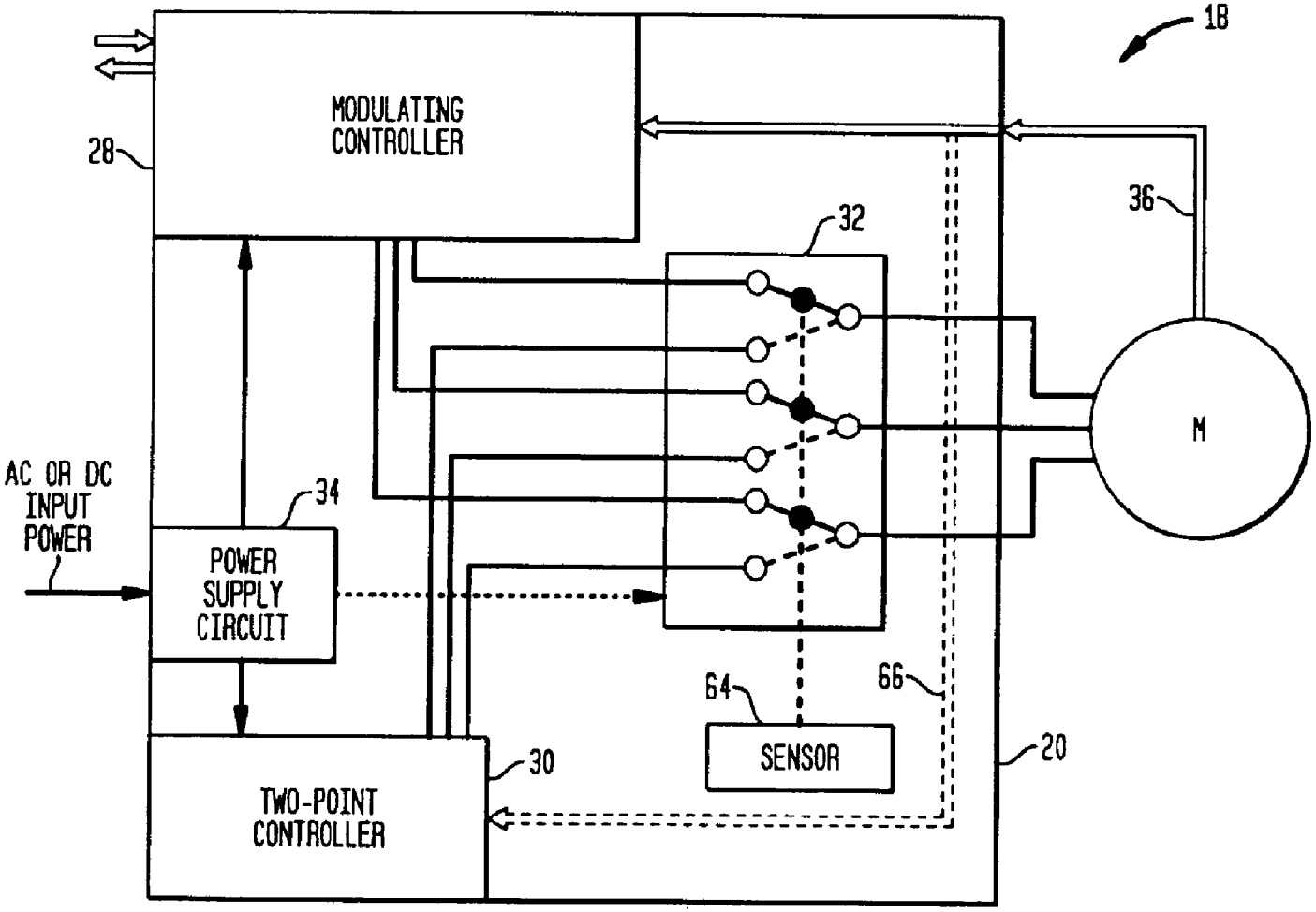
FIG. 5 shows a block diagram of an embodiment of a damper actuator in accordance with the principles of the subject invention.

Referring now to FIG. 5, there is depicted a block diagram of the electronics of actuator 20. The electronics shown in FIG. 5 particularly depicts a manner of connecting the modulating controller 28 and the two-point controller 30 to the thermal switch 32, the internal switching thereof, and the connection of the switch 32 to the motor 22. Moreover, the switch 32 is shown coupled to a thermal sensor 64 that provides a control signal to the switch or switch like device 32 when a pre-determined temperature is reached. The control signal is operative to cause the switch 32 to change states (i.e. switch over the control from the modulating controller 28 to the two-point controller 30). While the sensor 64 is shown external to the switch 32, it should be appreciated that the sensor 64 may be internal to the switch 32 or external to the actuator 20. Further depicted is a feedback line 66 from the motor 22 that may be used by the two-point controller 30 for control of the motor 22.

The subject damper actuator 20 thus provides adjustable control of the damper 24 via the modulating controller 28 during normal operation, on/off (fully open/fully closed) control of the damper 24 via the two-point controller 30 during a sensed fire and smoke/heat/emergency condition, and a return to a predetermined zero position control of the damper 24 via a biased spring or the like during a fire and smoke condition when power to the damper actuator has been cut off.

Moreover, the subject invention provides a ventilation damper that acts in a two point mode which fulfills all U/L 555(S) (i.e. a U/L specification that covers the requirements for approving a fire and smoke rating of an actuator and damper assembly) requirements for fire and smoke operation. The present ventilation damper would never be required to resume operation in the modulating mode because it will be disposed of after a smoke/fire emergency. Thus, the permanent switch-over from the modulating mode to the on/off mode provides clear evidence that a ventilation damper system needs replacement. In this manner, no further means for indicating an exposure to high temperature levels are necessary.

What is claimed is:

1. A damper actuator comprising:

a motor adapted to control a ventilation damper;

a thermally actuated switch coupled to said motor;

first motor control circuitry coupled to said switch; and second motor control circuitry coupled to said switch;

said thermally actuated switch having a first state wherein said first motor control circuitry is coupled to said motor for operational control of said motor and said second motor control circuitry is decoupled from operational control of said motor, and a second state wherein said second motor control circuitry is coupled to said motor for operational control thereof and said first motor control circuitry is decoupled from operational control of said motor.

2. The damper actuator of claim 1, wherein said second motor control circuitry is configured to cause said motor to put the damper in one of a fully open position and a fully closed position.

3. The damper actuator of claim 1, wherein said first motor control circuitry is configured to cause said motor to put the damper into a first position, a second position, and at least one position intermediate said first position and said second position.

4. The damper actuator of claim 1, wherein said thermally actuated switch is operative to change from said first state to said second state when said thermally actuated switch reaches approximately a pre-determined temperature.

5. The damper actuator of claim 1, wherein said first state of said thermally actuated switch is a normal state of operation and said second state of said thermally actuated switch is a fire control state of operation.

6. The damper actuator of claim 1, wherein said thermally actuated switch comprises a one-way thermostatic switch.

7. A ventilation damper actuator comprising:

a motor configured to control a ventilation damper;

a modulating controller adapted to control said motor;

a two-point controller adapted to control said motor; and a switch having a first input connected to said modulating controller, a second input connected to said two-point controller, and an output connected to said motor, said switch normally coupling said modulating controller to said motor for operational control of said motor and responsive to a pre-determined thermal condition wherein said modulating controller is de-coupled from said motor and said two-point controller is coupled to said motor for operational control of said motor.

8. The ventilation damper actuator of claim 7, wherein said two-point controller is operative to cause said motor to put the ventilation damper in either a fully open position or a fully closed position.

9. The ventilation damper actuator of claim 7, wherein said modulating motor controller is operative to cause said motor to put the ventilation damper into a fully open position, a fully closed position, and a plurality of positions intermediate said fully open and said fully closed positions.

10. The ventilation damper actuator of claim 7, wherein said switch comprises a thermally actuated switch.

11. The ventilation damper actuator of claim 10, wherein said thermally actuated switch comprises a one-way thermostatic switch.

12. A method of controlling a ventilation damper comprising the steps of:

providing a damper actuator, the damper actuator having a motor configured to control the ventilation damper, a modulating controller adapted to control the motor, a two-point controller adapted to control the motor, and a switch having a first input connected to the modulating controller, a second input connected to the two-point controller, and an output connected to the motor, the switch having a first state wherein the modulating controller is coupled to the motor for operational control thereof and a second state wherein the two-point controller is coupled to the motor for operational control thereof;

operating the damper actuator with the switch in the first state in the absence of a fire event; and operating the damper actuator with the switch in the second state during a detected fire event.

13. The method of claim 12, wherein the step of operating the damper actuator with the switch in the second state first includes the step of setting the switch into the second state during a fire event.

14. The method of claim 12, wherein the switch comprises a thermally actuated switch.

15. The method of claim 14, wherein the thermally actuated switch comprises a one-way thermostatic switch.

16. The method of claim 12, wherein the damper actuator further includes a spring return operative to bias the damper into the fully closed position; and the method further includes the step of allowing the spring return to bias the damper into the fully closed position during a power interrupt.

17. The method of claim 12, wherein said two-point controller is operative to cause said motor to put the ventilation damper in either a fully open position or a fully closed position.

18. The method of claim 12, wherein said modulating motor controller is operative to cause said motor to put the ventilation damper into a fully open position, a fully closed position, and a plurality of positions intermediate said fully open and said fully closed positions.

* * * * *